United States Patent [19]

Lattner

[11] 4,040,384

[45] Aug. 9, 1977

[54] APPARATUS FOR SCRUBBING STAIN INTO SHEET OR BOARD MATERIAL

[75] Inventor: Elmer A. Lattner, Kirkwood, Mo.

[73] Assignee: PPG Industries, Inc., Pittsburgh, Pa.

[21] Appl. No.: 659,391

[22] Filed: Feb. 19, 1976

[51] Int. Cl.[2] ..... B05C 11/02

[52] U.S. Cl. ..... 118/120; 118/113; 118/325; 427/368

[58] Field of Search ..... 118/120, 113, 325; 427/368

[56] References Cited

U.S. PATENT DOCUMENTS

| | | | |
|---|---|---|---|
| 593,896 | 11/1897 | Johnson | 118/325 X |
| 820,666 | 5/1906 | Newell et al. | 118/120 |
| 1,675,066 | 1/1928 | Thorne | 118/120 |
| 1,860,664 | 5/1932 | Edgecumbe et al. | 427/368 |
| 2,348,817 | 5/1944 | Irvine | 118/120 X |
| 3,687,709 | 8/1972 | Prinz | 118/113 X |
| 3,961,108 | 6/1976 | Rosner et al. | 427/368 X |

FOREIGN PATENT DOCUMENTS

| | | | |
|---|---|---|---|
| 875,779 | 8/1961 | United Kingdom | 118/120 |

*Primary Examiner*—James Kee Chi

*Attorney, Agent, or Firm*—William J. Uhl; J. Timothy Keane

[57] ABSTRACT

A method and a machine for scrubbing stain, particularly aqueous latex stain, into cellulosic sheet and board material are disclosed. The machine comprises at least one and usually a series of strip brushes designed to oscillate at varying frequencies with variable strokes to work the stain into the cellulosic substrate. In one embodiment of the invention, side brushes as well as top surface brushes are provided to stain the sides as well as the top surface of the cellulosic material.

10 Claims, 10 Drawing Figures

APPARATUS FOR SCRUBBING STAIN INTO SHEET OR BOARD MATERIAL

BACKGROUND OF THE INVENTION

Field of the Invention: The present invention relates to a method and an apparatus for staining board and sheet material. More particularly, this invention relates to a method and apparatus for scrubbing a stain, particularly an aqueous latex stain, into the surface of a cellulosic sheet or board material.

Brief Description of the Prior Art: Staining compositions are used for protecting and coloring cellulosic, particularly wood surfaces. Until about 1970, oil-based stains had been used almost exclusively by both the commerical prestaining industry and by individual consumers. However, since 1970, aqueous latex stain has rapidly been supplanting the more commonly used oil-based stain, particularly among individual consumers. Aqueous latex stain has better durability and color stability than oil-based stain and cleans up easily with soap and water. However, aqueous latex stain has not been fully utilized by the commercial prestaining industry.

One of the problems with aqueous latex stain is that it does not adhere or penetrate the cellulosic material as quickly as oil-based stain. The commerical prestaining industry operates commercial staining equipment at fast line speeds. Since the aqueous latex stain does not penetrate the wood as quickly as oil-based stain, latex is not usable on most commercial prestaining equipment without extensive modifications.

In commercial prestaining, the cellulosic surface is first flooded with a staining composition following by passing the flooded surface between nip rolls to force the stain into the surface and to remove excess which is collected and recirculated. The substrate is then passed beneath a rapidly rotating brush to remove any additional excess stain. When aqueous latex stain is employed with this type of equipment, very little of the stain anchors itself to the wood and as a result, only semi-transparent staining is obtained.

Although not completely understood, one of the reasons that latex stain does not adhere or penetrate as quickly to cellulosic substrates as oil-based stain is because of the different resin binders used in the two systems. In addition to pigment, oil-based stains contain linseed oil or alkyd resins or combination of these two as binders for the pigment. These resins penetrate cellulose quickly and secure the pigment firmly to the substrate. The resin and pigment is not readily brushed off the surface, thus allowing good solid hiding of the substrate. Latex resin molecules, on the other hand, are surrounded by a film of water which acts as a lubricant on the surface of the cellulosic substrate and can be easily swept away along with pigment and resin when moved under rapidly rotating brushes. This results only in semitransparent covering not solid hiding which is increasingly in demand.

The present invention provides a new method and machine for applying aqueous latex stain to cellulosic substrates. In the present invention, the aqueous latex stain is scrubbed into the cellulosic substrate. Thus, the present invention provides a method and apparatus which can be used by the commercial prestaining industry for applying aqueous latex stain to cellulosic substrates. The present invention offers many advantages over prior art equipment. In the present invention, only sufficient stain, which is required to get a desired degree of staining, is applied to the surface of the cellulosic substrate. There is not flooding of the surface with stain, or removal of excess stain, which was required by prior art techniques in the application of oil-based stains. Thus, the problems associated with these prior art techniques such as stain waste; recirculatory pump problems; long, difficult and costly clean ups and poor drying due to uneven coating are avoided.

SUMMARY OF THE INVENTION

In accordance with the present invention, a method of staining sheet and board material and a machine for scrubbing stain into the sheet and board material are provided.

In the method of the invention, a staining composition is applied to the surface of the material in an amount sufficient to obtain a desired degree of hiding without flooding the surface of the cellulosic material. The stain is scrubbed into the surface of the cellulosic material with an oscillating brush which oscillates at a varying frequency with various length strokes to scrub the stain into the surface of the cellulosic material. After scrubbing, the stain is dried on the substrate.

The machine for scrubbing the stain into the cellulosic material comprises a frame adapted to be positioned over a conveyor which conveys the cellulosic material through the machine. A supporting member, located above the material to be stained, is adjustably connected to the frame so that it may be raised and lowered and has mounted to its bottom surface at least one strip brush arranged to contact the top surface of the material being conveyed through the machine. The strip brush extends substantially across the width of the material being conveyed. The mounting member is designed to oscillate at varying frequency with various length strokes to scrub the stain into the cellulosic material.

The frequency of oscillation and length of stroke are varied as needed for any of the following conditions: conveyor speed, amount of staining composition applied, type of staining composition applied (solid or semi-transparent), type or texture of cellulosic material being stained.

DETAILED DESCRIPTION

Figure 1:
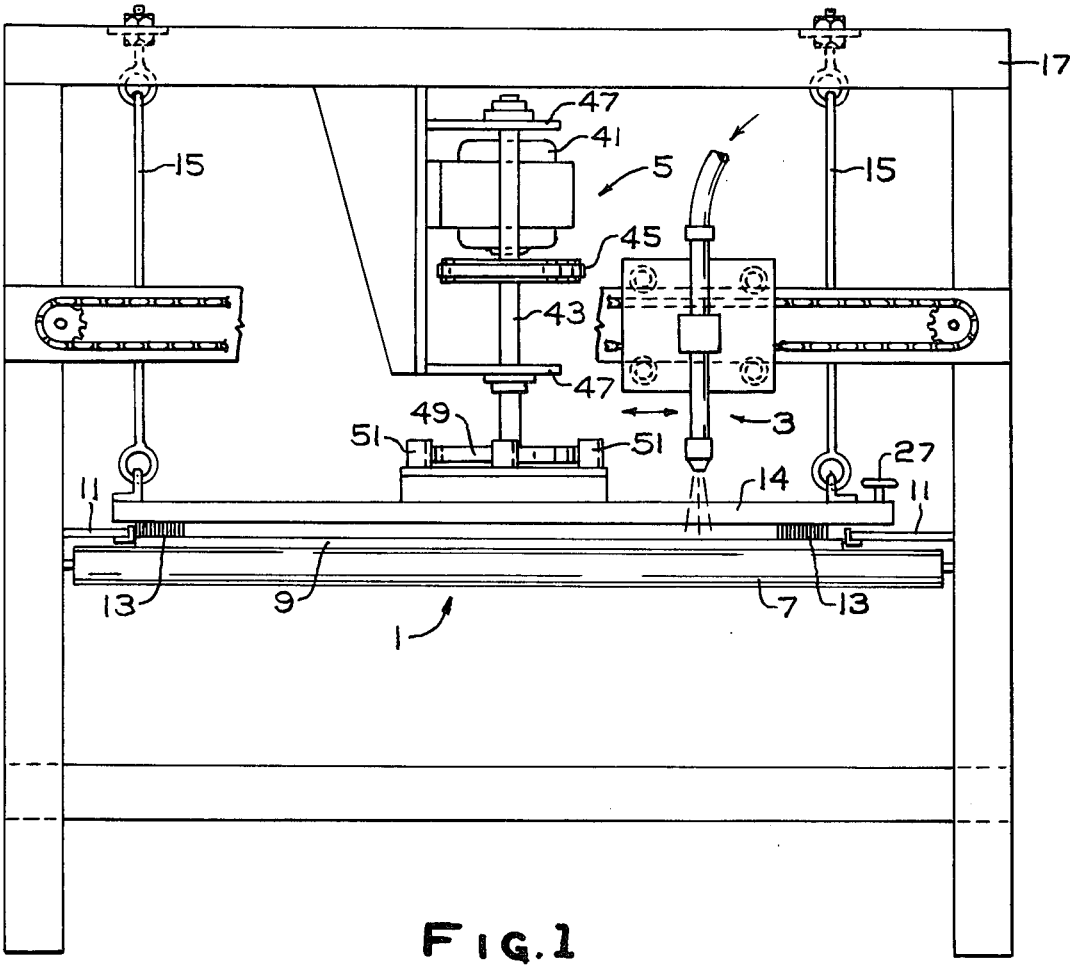
FIG. 1 is an end elevational view showing the apparatus of the invention.
Figure 2:
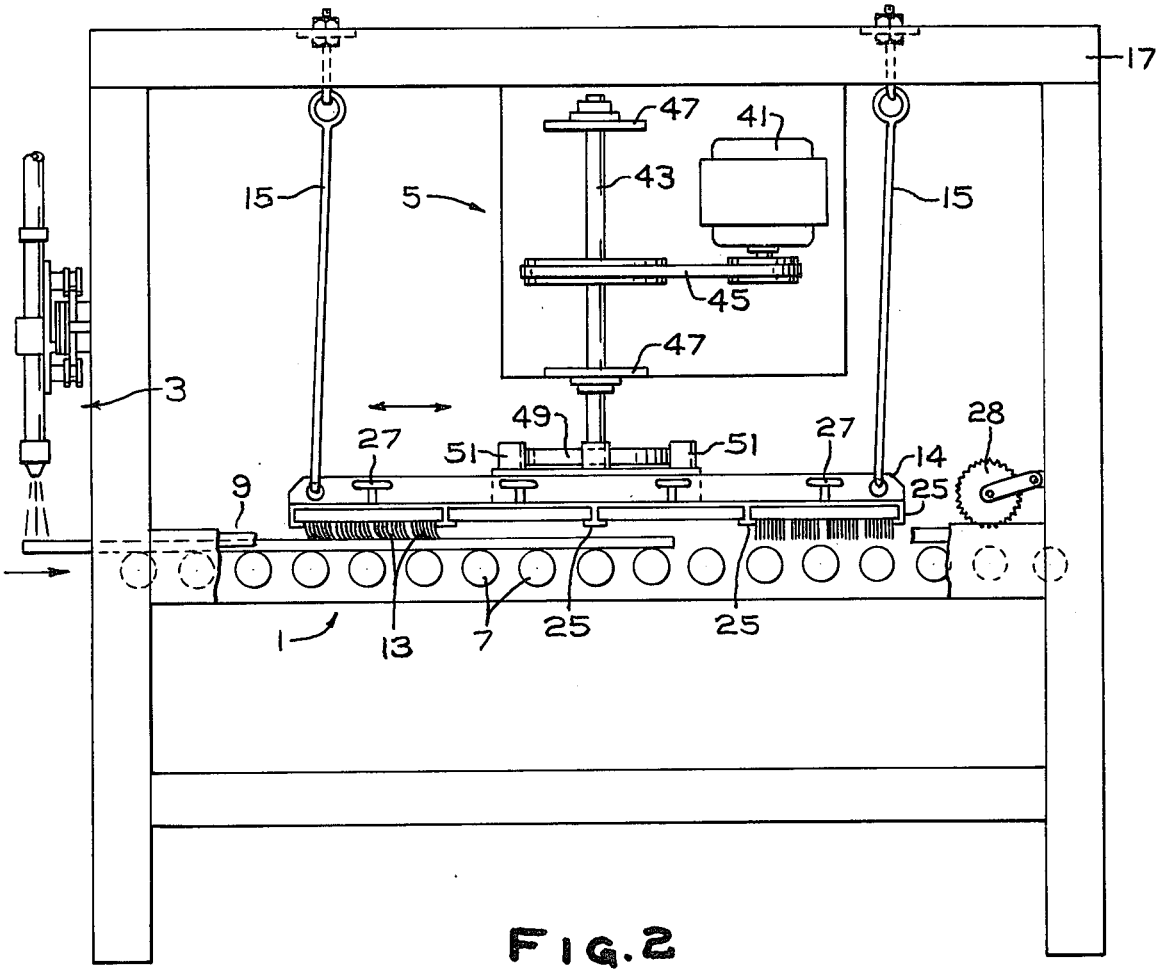
FIG. 2 is a side elevational view showing the apparatus of the invention.

The machine for practicing the present invention is shown in the accompanying Figures. Referring to FIGS. 1 and 2, a conveying 1, spraying 3 and scrubbing system 5 is shown. The conveying system comprises a series of powered conveyor rolls 7, designed to convey the sheet or board material 9 through the apparatus. Besides rollers, other conveying means such as endless belts and chain or cable with cross strips could also be used.

The spraying system shown in FIGS. 1 and 2 is a conventional reciprocal spraying system designed to continuously transverse the board or sheet material being stained. Besides a reciprocating spray system, other conventional systems such as a stationary spray or a rotary spray system could be used.

The amount of stain applied to the board or sheet material should be that sufficient to obtain the desired degree of hiding without flooding the surface of the material. By flooding the surface of the material is meant that stain excess of that required for the top surface and sides of the material is used resulting in excessive overflow. Flooding is a technique used with prior art staining machines described above.

In general, a wet film of about 3 to 7 mils is applied to the surface of the material to be stained. The wet film thickness will vary depending somewhat on the viscosity and solids content of the staining composition, on the porosity of the material being stained, on the speed of the machine, on the degree of hiding desired (that is, solid or semi-transparent), the hiding power of the stain and the ability of the stain to seal the varying surface textures and porosity. If forced dry ovens are used, the drying ability of the oven in relation to conveyor speed would determine wet film measurement feasible for one coat.

After the staining composition has been applied, the sheet or board material is passed to and through a scrubbing station. As shown in FIG. 1, the board or sheet material is conveyed by rollers and aligned by guide members 11 on its way to the scrubbing station. The scrubbing station involves at least one and usually a series of strip brushes 13 which extend substantially across the width of the sheet or board material being conveyed through the scrubbing station. The brushes are connected to a power source designed to oscillate the brushes oscillating at varying frequencies over the range of about 60 to 400 oscillation per minute and with varying lengths of strokes, that is, about ⅜ inch to 4 inches, principally in a forward-backward movement along the line of travel of the sheet or board material being conveyed through the apparatus. A combination of relatively rapid oscillations with relatively short strokes and fast conveyor speeds scrubs the stain into the surface of the material where the stain anchors and provides the required semi-transparent appearance when needed. When solid hiding appearance is desired, the length of the stroke can be lengthened and frequency of oscillations slowed to accommodate slower conveyor speed and reduced chance of drying stain on the surface of the substrate while still in contact of brush strips.

Figure 3:
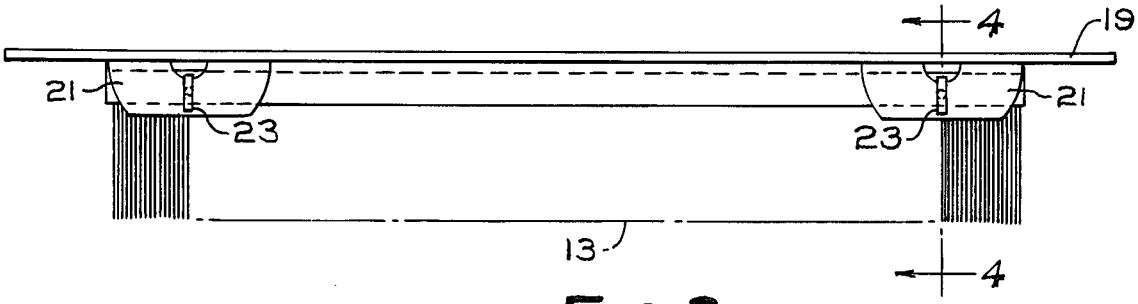
FIG. 3 is an elevational view of a strip brush used with the apparatus of the invention.
Figure 4:
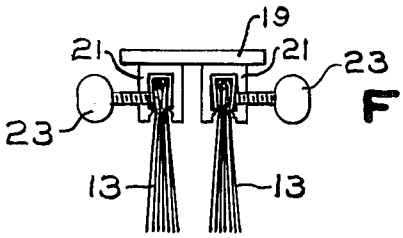
FIG. 4 is a cross-sectional view along 4—4 of FIG. 3.

The scrubbing station comprises a structural member 14 shown as a mounting plate in FIGS. 1 and 2 which is suspended by adjustable cables 15 to a frame 17 positioned over the conveyor. The mounting plate is located above the material to be stained and may be raised or lowered to accommodate varying thicknesses of material. The mounting plate has affixed to its bottom surface at least one and usually a plurality of scrubbing brushes 13 which extend substantially across the width of the material being stained and rest with slight pressure on the top surface. As is shown in some detail in FIGS. 3 and 4, the brushes are strip brushes which are easily removable from the mounting plate for cleaning and color change. The strip brushes can be affixed to the mounting plate in any convenient fashion which promotes for their easy removal. Thus, as is shown in FIGS. 3 and 4, the strip brushes can be attached to a tray 19 with clips 21 and secured in plate with fasteners 23. Usually the strip brushes are ganged together to form a cluster and then more than one cluster used in tandem as is shown in FIG. 2. The trays are secured to the mounting plate through flange members 25 which can be tightened with keys 27 so as to firmly secure the trays to the plate. The mounting plate can support more than one tray.

The number of trays and attached brushes employed will depend on several factors such as conveyor speed, substrate absorption of stain, frequency of oscillation, length of stroke and wet film thickness of stain.

Panels to be stained such as plywood and overlay sheets are often warped or bowed. To keep the sheets flat and prevent marring of the sheet surface, serrated rollers, shown as 28 in FIG. 2, can be used to hold the sheets down.

It is important for complete surface staining to leave the board or panel surface slightly wet when it leaves the scrubber because the oscillating brushes may brush off splinters or flakes and unless the brush tips are wet with stain, the spots under the removed splinters or flakes will not be stained leaving an unfinished appearance. The oscillation frequency, length of stroke and number of brush strips used must be coordinated to allow the stained material to be slightly wet when it leaves the scrubber.

FIGS. 5 through 9 show some alternate brush designs which are useful in the practice of the present invention.

Figure 5:
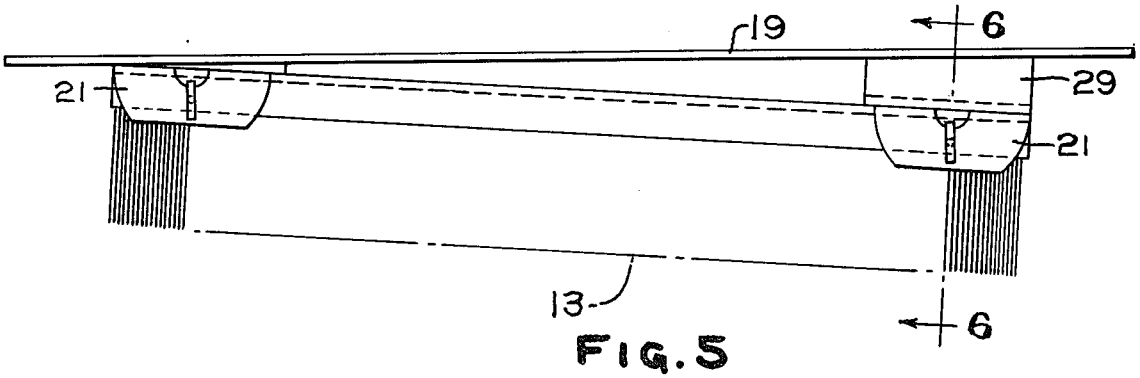
FIG. 5 is an elevational view of a strip brush for use with beveled surfaces.
Figure 6:
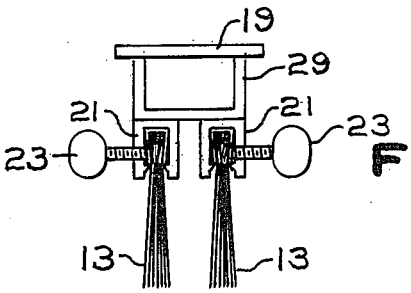
FIG. 6 is a cross-sectional view taken through 6—6 of FIG. 5.

FIGS. 5 and 6 show an angle strip brush for scrubbing beveled siding. The brush is secured to the tray with a clip 21 such as is generally shown in FIG.3. A channel member 29 can be welded to the tray at one end so as to put the brush on an angle.

Figure 7:
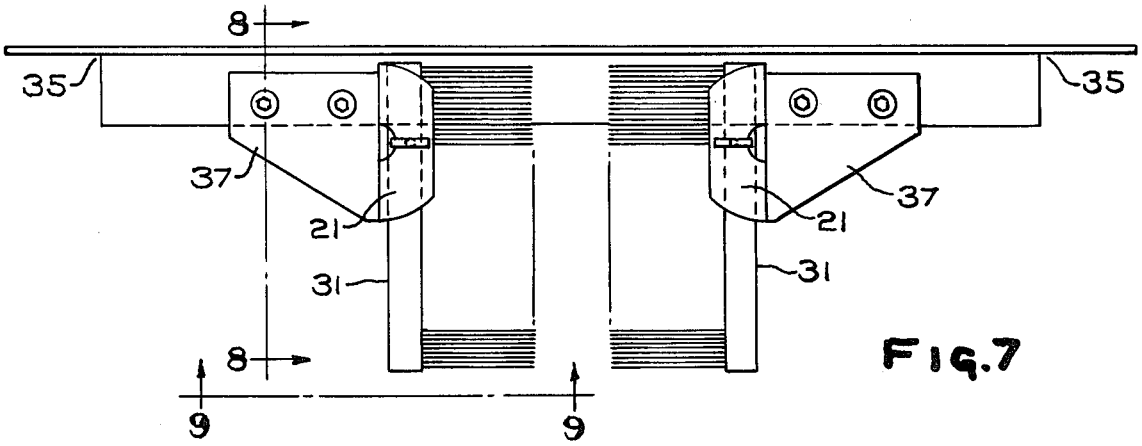
FIG. 7 is an end elevational view showing an edge brush attachment for use with the apparatus of the invention.
Figure 8:
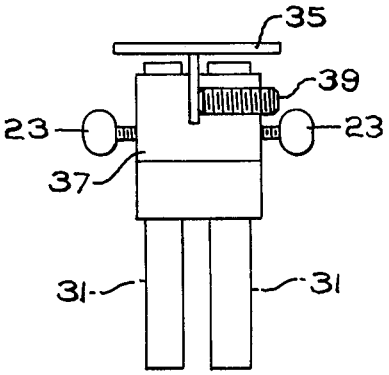
FIG. 8 is a cross-sectional view taken along 8—8 of FIG. 7.
Figure 9:
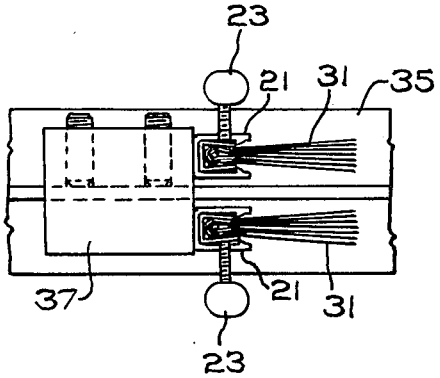
FIG. 9 is a cross-sectional view taken along 9—9 of FIG. 7.
Figure 10:
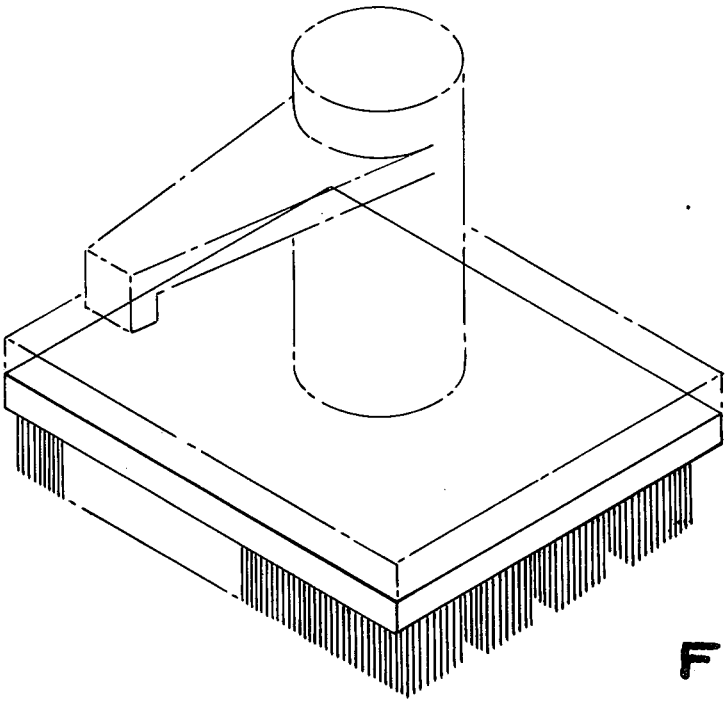
FIG. 10 is a hand-controlled brush.

FIGS. 7 through 9 show edge brushes 31 designed to scrub the edges of thicker material being conveyed through the apparatus. With thin sheet material such as one-half inch thick plywood, edge brushes are not necessary to scrub stain into the side edges. However, with thickness material such as 1, 2 or 3 inch thick board material, edge brushes are required. The edge brushes are affixed to T-member 35 which is secured to the mounting plate with flange members such as described above in connection with FIG. 2. The edge brushes are secured to the T-member through adjustable fastening members 37 and clips 21. The edge brushes are inserted from the bottom up through the clips and secured by fasteners 23. The clips are secured to the adjustable fastening member which in turn is secured to the T-member with set screws 39. When the set screws are loosened, the adjustable fastener may be adjusted horizontally or vertically to accommodate varying widths and thicknesses of sheet and board material.

The type and stiffness of the bristle in the brushes are varied depending on the stain employed in the material being stained. Natural or synthetic bristle filaments can be used. With aqueous latex stain, synthetic bristle is preferred with the stiffness of the bristle ranging from about 0.004 inch to 0.008 inch (in diameter). With a very rough board such as cedarboard and rough sawn plywood, a medium stiff bristle brush such as a 0.008 inch bristle sould be used. With a very smooth board such as MASONITE or medium density overlay board, a very soft brush such as a 0.006 or 0.004 inch bristle which will not scratch or mar the surface of the material being stained should be used.

As mentioned above, the brush oscillates at varying frequencies with varying length strokes. The oscillation can be imparted to the brushes in any manner convenient such as is shown by the oscillating cam mechanism in FIGS. 1 and 2. The mechanism depicted by the drawings shows a driving means such as an electric motor 41 which rotates a drive shaft 43 through belt drive 45. The drive shaft is journaled and secured at 47. At one end of the drive shaft is a rotating eccentric cam 49 which imparts the oscillating movement to the brushes by engaging cam followers 51 which are secured to the top of the mounting plate.

After the board or sheet material has passed through the scrubbing station, it is then dried. Drying may be conducted in any convenient fashion. Thus, the cellulosic sheet or board material after passing through the scrubbing station may be conveyed directly into an oven where drying can be conducted at elevated temperature. Alternately, the cellulosic sheet or board material may be removed from the conveyor line and stacked in racks for either oven or air drying at ambient temperature.

As mentioned above, the scrubbing machine of the present invention is particularly designed for scrubbing an aqueous latex stain into a cellulosic substrate. Examples of suitable cellulostic substrates are conventional plywood sheets and board such as cedar, redwood, fir and pine. Examples of other suitable cellulostic substrates include particle board, hardboard and wood fiber overlay board. Rough and smooth surfaces are readily stained with this system.

Besides aqueous latex stain, the invention can also be used with any type of stain such as oil-based stains. By a staining composition is meant a coloring or a protective liquid which when applied to a substrate penetrates into the substrate and although capable of hiding the grain of the substrate, permits its texture to show through. Thus, transparent and semi-transparent stains which permit the grain of the wood to show through as well as opaque stains which hide the grain but permit the texture of the wood to show through can be used. The stains differ from paints and other protective coatings in that they penetrate and leave little film build up, whereas paints form a protective film on the surface of the wood with little penetration. The staining compositions contain pigment, vehicle and solvent and are generally of relatively low solids content and viscosity as compared to paint compositions. Stains generally contain from about 15 to 30 percent volume solids and have an Efflux Viscosity of 15 to 120 seconds determined at room temperature with a Ford No. 4 cup on an Efflux Viscosimeter (supplied by Gardner Laboratories of Bethseda, Maryland, Ser. No. 4942). Particular suitable aqueous stains are those sold by PPG Industries, Inc. under the trademark REZ.

While one complete embodiment of the invention has been described in detail, it is not to be understood that the invention is limited to the embodiment so disclosed. On the contrary, it is realized that numerous modifications and variations will occur to those skilled in the art without departing from the spirit of the invention or the scope of the appended claims.

Having thus described the invention, what is claimed and desired to be secured by Letters Patent is:

1. An apparatus for scrubbing a stain into sheet and board material being conveyed through said apparatus, comprising:

A. a frame adapted to be positioned over a conveyor which conveys sheet or board material through said apparatus;

B. a structural member connected to said frame; the structural member having mounted thereto at least one strip brush arranged to contact the top surface of the material being conveyed through the apparatus, said strip brush extending substantially across the width of the material being conveyed;

C. means mounted on said frame member and connected to said structural member for oscillating said structural member and said strip brush mounted thereon at varying frequency with various length strokes to scrub the stain into the surface of said sheet or board material.

2. The apparatus of claim 1 in which the strip brushes are removable from said structural member.

3. The apparatus of claim 1 in which the structural member can be raised or lowered.

4. The apparatus of claim 1 in which the strip brushes oscillate in a forward-backward movement along the line of travel of the material being conveyed through the apparatus.

5. The apparatus of claim 1 in which the frame is detached from said conveyor.

6. The apparatus of claim 1 in which the structural member extends substantially across the width of the material being conveyed through the apparatus.

7. The apparatus of claim 6 in which the structural member has affixed in a removable fashion to its bottom surface thereof at least one tray which in turn has affixed thereto in a removable fashion at least one strip brush which extends substantially across the width of the material being conveyed through said apparatus.

8. The apparatus of claim 1 in which in addition to the strip brushes, the structural member has mounted thereon at least two edge brushes arranged to contact the side surfaces of material being conveyed through the apparatus.

9. The apparatus of claim 8 in which the edge brushes are adjustable to accommodate varying widths of material.

10. The apparatus of claim 1 in which the structural member is oscillated by the action of a rotating eccentric cam.

* * * * *